US009471005B2

(12) United States Patent
Itabashi

(10) Patent No.: US 9,471,005 B2
(45) Date of Patent: Oct. 18, 2016

(54) DEVELOPING CARTRIDGE POSITIONING PORTIONS FOR RELATIVE POSITIONING OF DEVELOPING ROLLER, SUPPLY ROLLER AND HOUSING

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/740,616

(22) Filed: Jun. 16, 2015

(65) Prior Publication Data

US 2015/0277284 A1 Oct. 1, 2015

Related U.S. Application Data

(63) Continuation of application No. 13/599,005, filed on Aug. 30, 2012, now Pat. No. 9,086,654.

(30) Foreign Application Priority Data

Aug. 31, 2011 (JP) ..... 2011-190043

(51) Int. Cl.
*G03G 15/08* (2006.01)
*G03G 21/18* (2006.01)

(52) U.S. Cl.
CPC ..... *G03G 15/0865* (2013.01); *G03G 15/0896* (2013.01); *G03G 21/181* (2013.01); (Continued)

(58) Field of Classification Search
CPC ..... G03G 15/0896; G03G 21/181; G03G 2215/0869; G03G 2215/0872
USPC ..... 399/109, 119, 222, 281
See application file for complete search history.

(56) References Cited

U.S. PATENT DOCUMENTS 7,403,734 B2 7/2008 Okamoto et al.
7,630,666 B2 12/2009 Nakaya et al.
(Continued)

FOREIGN PATENT DOCUMENTS

JP S58-57151 A 4/1983
JP 2006-126299 A 5/2006
(Continued)

OTHER PUBLICATIONS

Office Action issued corresponding Chinese Application No. 201210324531.7 mailed Mar. 4, 2014.
(Continued)

*Primary Examiner* — David Gray
*Assistant Examiner* — Laura Roth
(74) *Attorney, Agent, or Firm* — Banner & Witcoff, Ltd.

(57) ABSTRACT

In a developing device, a developing agent member has a first rotational shaft extending in a first direction. A supply member has a second rotational shaft extending in the first direction. A housing includes a first wall and a second wall. The first wall is formed with first and second openings. The second wall is formed with third and fourth openings. The first bridge portion separates the first opening and the second opening in the first wall. A second bridge portion separates the third opening and the fourth opening in the second wall. When projected in the first direction, the first rotational shaft is disposed in the first opening and the second rotational shaft is disposed in the second opening. When projected in the first direction, the first rotational shaft is disposed in the third opening and the second rotational shaft is disposed in the fourth opening.

7 Claims, 10 Drawing Sheets

(52) U.S. Cl.
CPC ..... *G03G2215/0141* (2013.01); *G03G 2215/0869* (2013.01); *G03G 2215/0872* (2013.01); *G03G 2221/1684* (2013.01)

(56) References Cited

U.S. PATENT DOCUMENTS

| | | | | |
|---|---|---|---|---|
| 2007/0071489 | A1 | 3/2007 | Nakaya et al. | |
| 2011/0158687 | A1 | 6/2011 | Mori | |
| 2011/0158710 | A1 | 6/2011 | Shiraki et al. | |
| 2011/0311266 | A1* | 12/2011 | Taguchi ..... | G03G 15/0817 399/103 |
| 2012/0003012 | A1 | 1/2012 | Kato | |

FOREIGN PATENT DOCUMENTS

| | | | |
|---|---|---|---|
| JP | 2006-194986 | A | 7/2006 |
| JP | 2007093951 | A | 4/2007 |
| JP | 2011-133761 | A | 7/2011 |
| JP | 2011133768 | A | 7/2011 |

OTHER PUBLICATIONS

Office Action issued corresponding Chinese Application No. 201210324531.7 dated Nov. 3, 2014.
May 6, 2015—(CN) Decision of Rejection—App 201210324531.7.
Jul. 21, 2015—(JP) Office Action—App 2011-190043.

* cited by examiner

DEVELOPING CARTRIDGE POSITIONING PORTIONS FOR RELATIVE POSITIONING OF DEVELOPING ROLLER, SUPPLY ROLLER AND HOUSING

CROSS REFERENCE TO RELATED APPLICATION

This application is a continuation application of U.S. patent application Ser. No. 13/599,005 filed Aug. 30, 2012, which claims priority from Japanese Patent Application No. 2011-190043 filed on Aug. 31, 2011. The entire contents of the above noted applications are incorporated herein by reference.

TECHNICAL FIELD

The present invention relates to a developing device that mounts in an image-forming device such as a color printer.

BACKGROUND

An electrophotographic printer known in the art has developing devices detachably mounted therein. Each developing device includes a developing-device frame, and a developing roller and a supply roller supported in the developing-device frame.

One such developing device that has been proposed is a developer cartridge that includes a cartridge frame, a developing roller rotatably supported in the cartridge frame, and a supply roller rotatably supported in the cartridge frame while confronting and contacting the developing roller. The developer cartridge also includes grooves formed one each in the left and right side walls of the cartridge frame for receiving ends of a rotational shaft provided in the developing roller, and through-holes formed in the left and right side walls for inserting ends of a rotational shaft provided in the supply roller. The groove and through-hole formed in the left side wall are in communication.

SUMMARY

However, the cartridge frame in this conventional developer cartridge does not have sufficient strength because the groove and through-hole formed in the left side wall are in communication. Consequently, it is not always possible to position the supply roller and the developing roller supported in the cartridge frame relative to each other with sufficient precision, leading to inconsistent image-forming results.

Therefore, it is an object of the present invention to provide a developing device capable of enhancing the strength of the outer case constituting the developing device and capable of improving precision in positioning a developer-carrying member and developer-supplying member relative to each other. It is another object of the present invention to provide a method of manufacturing such a developing device.

In order to attain the above and other objects, the invention provides a developing device. A developing device includes a developing agent member, a supply member, a housing, a first bridge portion, and a second bridge portion. The developing agent member has a first rotational shaft extending in a first direction and is configured to carry developer. The supply member has: a main body extending in the first direction; and a second rotational shaft extending in the first direction, the main body contacts the developing agent member, and is configured to supply the developer to the developing agent member. The main body covers the second rotational shaft and has an adhering region in which the main body is adhesively fixed to the second rotational shaft. A length of the adhering region in the first direction is shorter than a length of the main body in the first direction. The housing accommodates the developer, and includes a first wall and a second wall opposed with each other in the first direction. The first wall is formed with a first opening and a second opening. The second wall is formed with a third opening and a fourth opening. The first bridge portion separates the first opening and the second opening in the first wall. The second bridge portion separates the third opening and the fourth opening in the second wall. When projected in the first direction, the first rotational shaft is disposed in the first opening and the second rotational shaft is disposed in the second opening. When projected in the first direction, the first rotational shaft is disposed in the third opening and the second rotational shaft is disposed in the fourth opening.

BRIEF DESCRIPTION OF THE DRAWINGS

The particular features and advantages of the invention as well as other objects will become apparent from the following description taken in connection with the accompanying drawings, in which:

FIG. 9(*b*) is a rear view of the lower frame 31 shown in FIG. 9(*a*);

FIG. 10(*b*) is a right side view of a lower frame according to a fourth embodiment.

DETAILED DESCRIPTION

1. Printer

Figure 1:
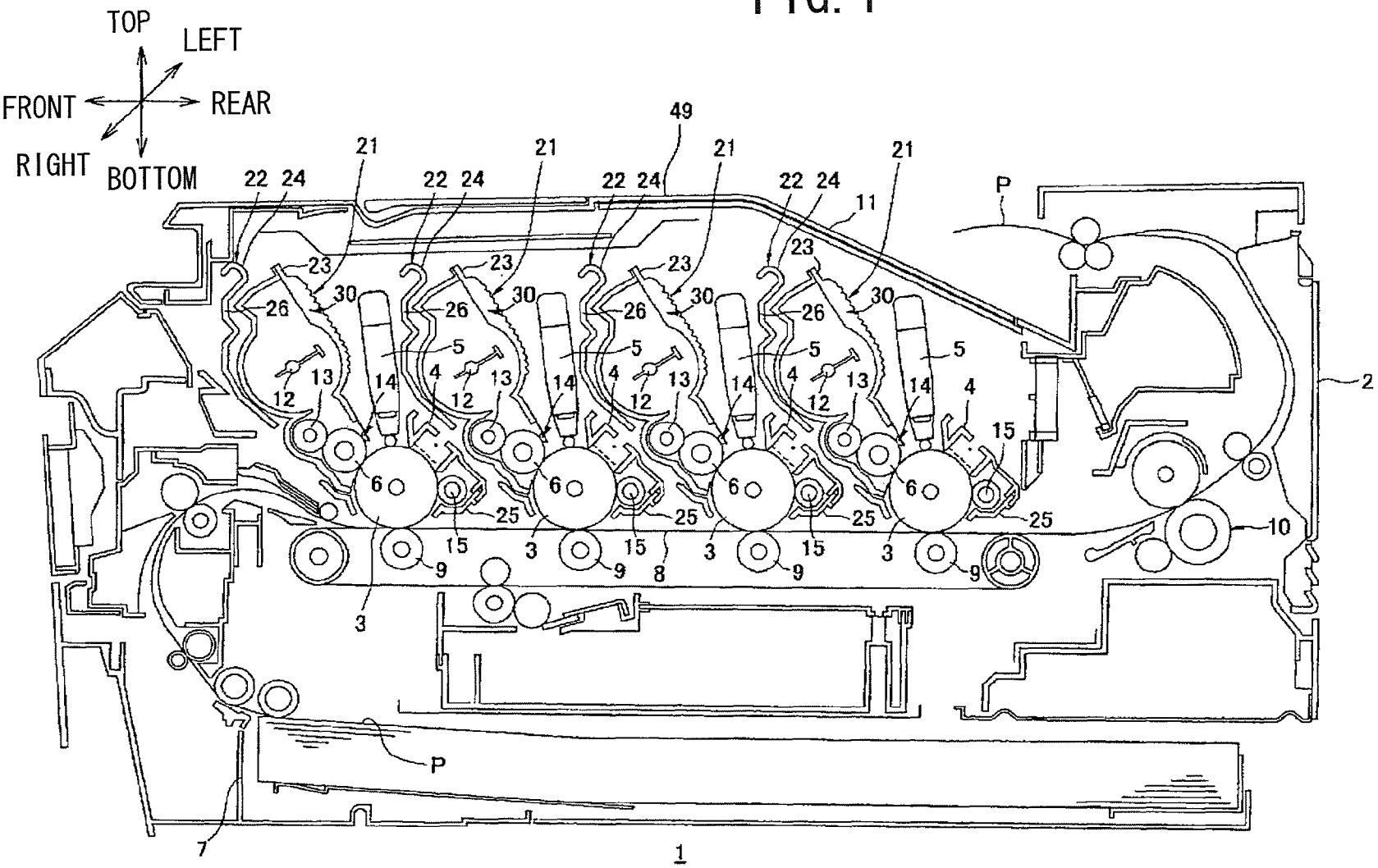
FIG. 1 is a lateral cross-sectional view of a printer according to a first embodiment of the present invention.

As shown in FIG. 1, a printer 1 is a direct tandem-type color printer.

In the following description, directions with respect to the printer 1 and developer cartridges 23 (described later) will correspond to the directions of the arrows indicated in the drawings and will assume that the printer 1 and the developer cartridges 23 are in a level orientation. In addition, the left-right direction will be equivalent to the width direction.

Specifically, the vertical and front-rear directions of the printer 1 differ from the vertical and front-rear directions of the developer cartridges 23. The developer cartridges 23 are mounted in the printer 1 and drum cartridges 22 so that their front side faces the upper front side of the printer 1 and their rear side faces the bottom rear side of the printer 1.

The printer 1 includes a main casing 2. Four photosensitive drums 3 are arranged inside the main casing 2 parallel to each other and juxtaposed in the front-rear direction. The four photosensitive drums 3 are differentiated according to the colors (black, yellow, magenta, and cyan) of toner images.

Disposed in opposition to each photosensitive drum 3 are a Scorotron charger 4, an LED unit 5, and a developing roller 6.

The surfaces of the photosensitive drums 3 are uniformly charged by the corresponding Scorotron chargers 4 and are subsequently exposed to light emitted by the corresponding LED units 5 based on image data, forming electrostatic latent images on the surfaces of the respective photosensitive drums 3. Toner carried on the developing rollers 6 is supplied to the corresponding latent images, producing visible toner images on the surfaces of the photosensitive drums 3.

Sheets P of a paper are accommodated in a paper cassette 7 inside the main casing 2. Various rollers are provided for supplying the sheets P from the paper cassette 7 to a conveying belt 8.

The conveying belt 8 is disposed between the photosensitive drums 3, and transfer rollers 9 disposed at positions confronting the respective photosensitive drums 3. A transfer bias is applied to the transfer roller 9 for sequentially transferring the toner images carried on the photosensitive drums 3 onto the sheet P so that the images are superimposed.

After toner images in the four colors have been transferred onto the sheet P, the sheet P is conveyed to a fixing unit 10. The fixing unit 10 fixes the toner images to the sheet P with heat. Various rollers are provided for subsequently discharging the sheet P into a discharge tray 11.

2. Process Cartridges

The printer 1 is provided with four process cartridges 21 corresponding to the four printing colors.

The process cartridges 21 are detachably mounted in the main casing 2 and are arranged parallel to one another and juxtaposed in the front-rear direction.

A top cover 49 is provided in the top wall of the main casing 2 and can be opened and closed. The process cartridges 21 can be mounted in or removed from the main casing 2 by opening the top cover 49.

Each process cartridge 21 includes a drum cartridge 22 detachably mounted in the main casing 2, and a developer cartridge 23 detachably mounted in the drum cartridge 22.

(1) Drum Cartridges

The drum cartridge 22 is configured of a drum frame 24. The drum frame 24 further includes a drum support part 25, and a developer-cartridge-accommodating part 26.

The drum support part 25 constitutes the lower rear side of the drum frame 24 and functions to support the corresponding photosensitive drum 3, the Scorotron charger 4, and a drum cleaning roller 15.

The photosensitive drums 3 are substantially cylindrical in shape and elongated in the left-right direction. The photosensitive drums 3 are rotatably supported in bottom ends of the respective drum support parts 25 and exposed through openings formed in the bottoms of the same. The Scorotron chargers 4 are disposed so as to confront the corresponding photosensitive drums 3 from a position diagonally above and rearward therefrom, but are separated from the same. The drum cleaning rollers 15 are disposed on the rear side of their corresponding photosensitive drums 3, confronting and contacting the same.

The developer-cartridge-accommodating part 26 of each drum frame 24 is provided above and forward from the drum support part 25 and is formed with an opening on the top and rear sides to allow mounting and removal of the corresponding developer cartridge 23.

(2) Developer Cartridges

Figure 2:
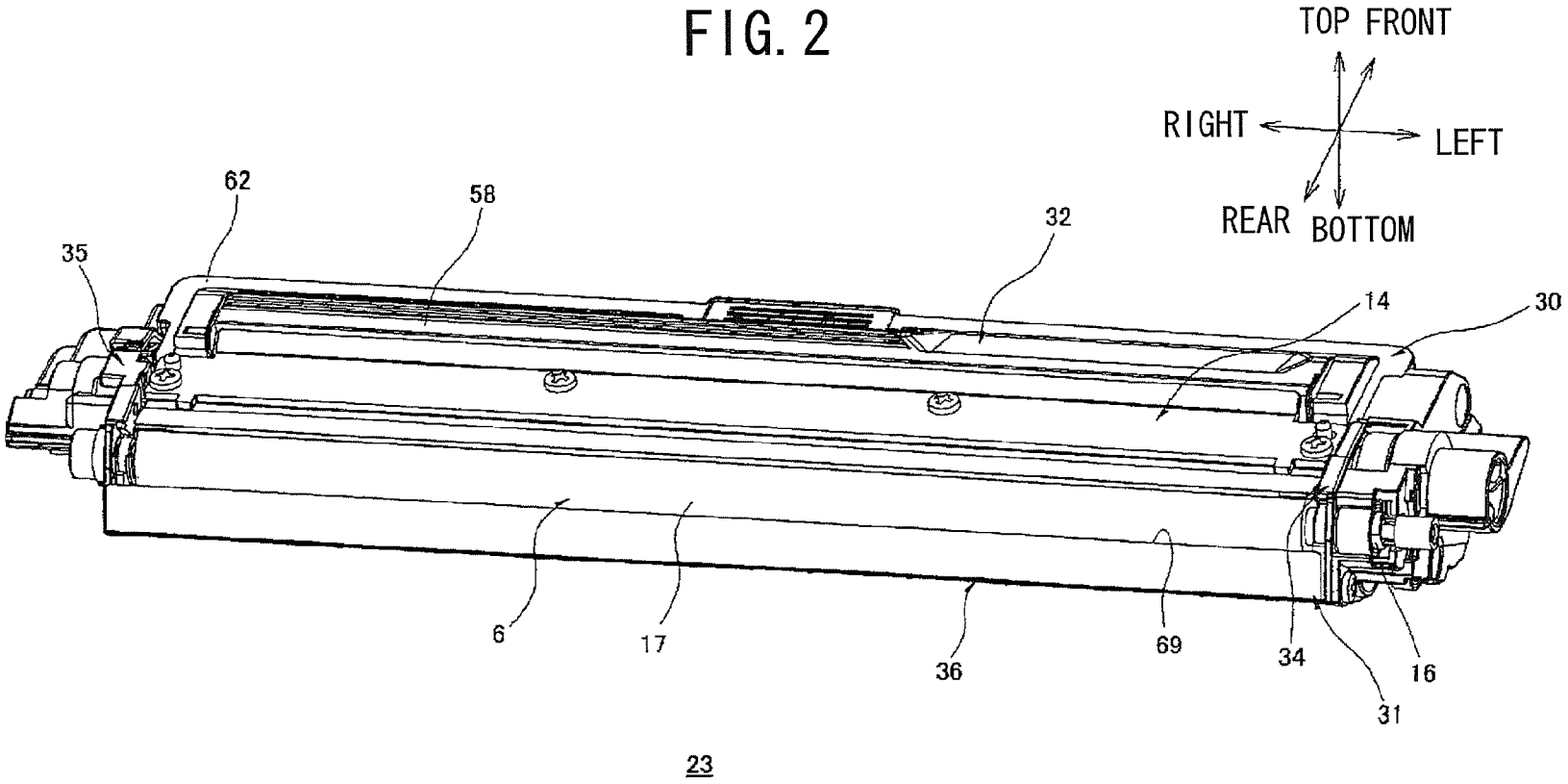
FIG. 2 is a perspective view of a developer cartridge according to the first embodiment of the present invention when viewed from a left-top side.
Figure 3:
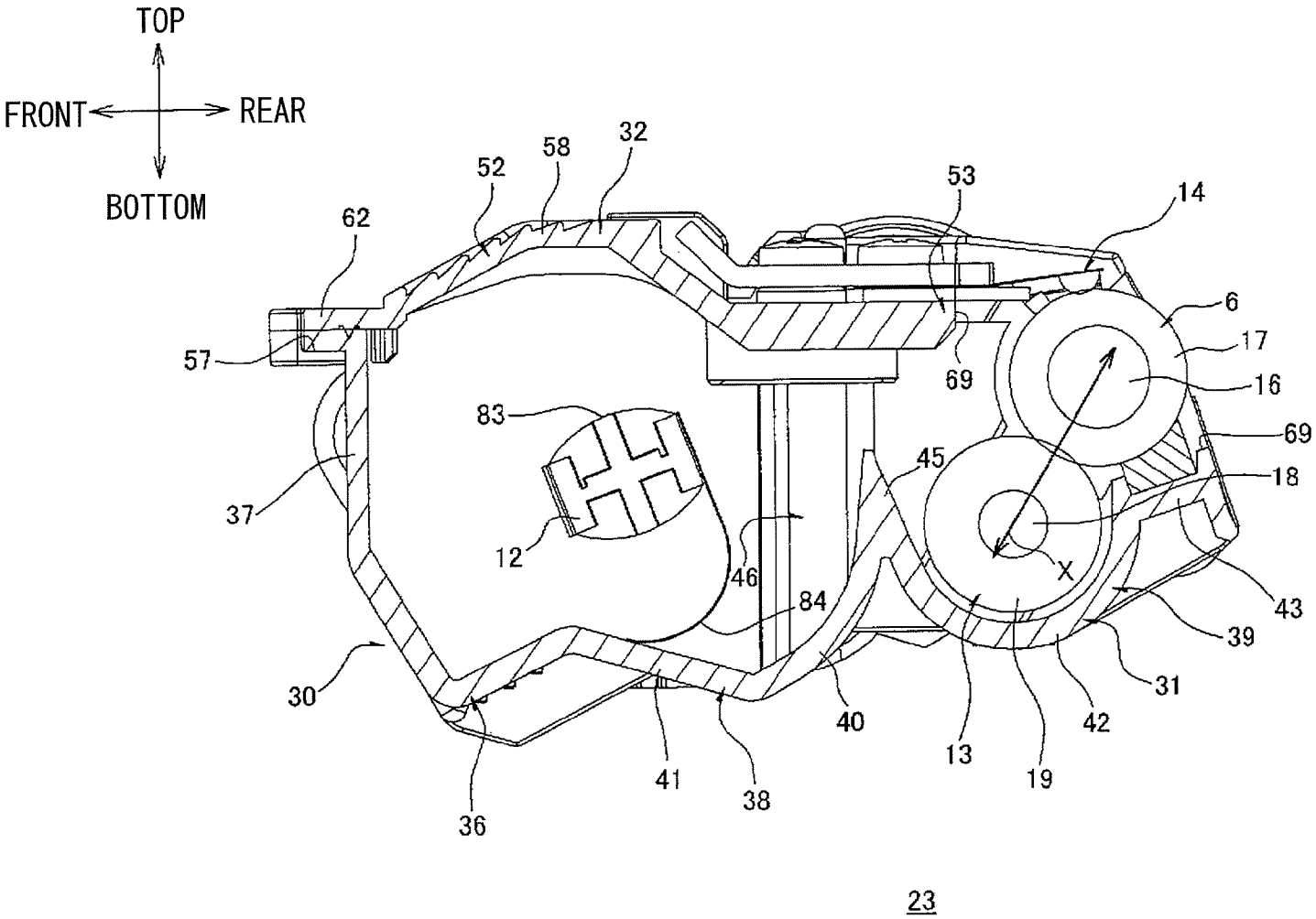
FIG. 3 is a lateral cross-sectional view of the developer cartridge shown in FIG. 2.

As shown in FIGS. 2 and 3, each of the developer cartridges 23 is configured of a developer frame 30. The developer frame 30 is a housing and generally box-shaped and elongated in the left-right direction. The developer frame 30 includes a lower frame 31, and an upper frame 32 assembled on the lower frame 31.

(2-1) Lower Frame

Figure 4:
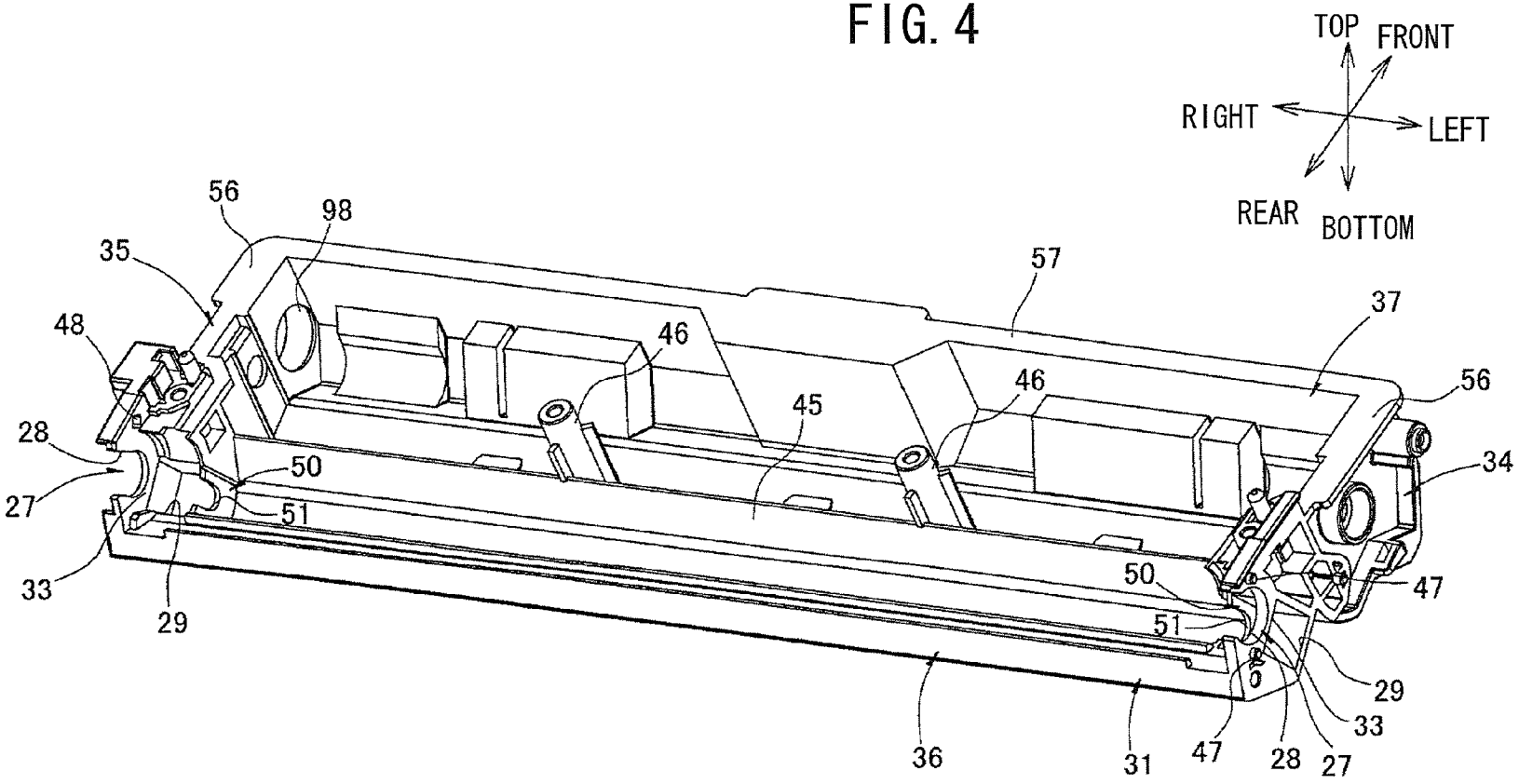
FIG. 4 is a perspective view of a lower frame when vied from a left-top side.

As shown in FIG. 4, the lower frame 31 is integrally configured of a left side wall 34 and a right side wall 35 arranged parallel to each other and separated in the width direction; a bottom wall 36 connecting the bottom edges of the left and right side walls 34 and 35; and a front wall 37 connecting the front edges of the left and right side walls 34 and 35 and the bottom wall 36.

The left and right side walls 34 and 35 have a generally flat plate shape. First contact parts 56 are formed on the front portion of the left and right side walls 34 and 35, and first openings 27 are formed in the rear portion of the left and right side walls 34 and 35.

Each of the first contact parts 56 has a generally flat plate shape. The first contact parts 56 are respectively provided on the top edges of the left and right side walls 34 and 35 and extend continuously outward from the top edges in corresponding left and right directions.

Figure 5:
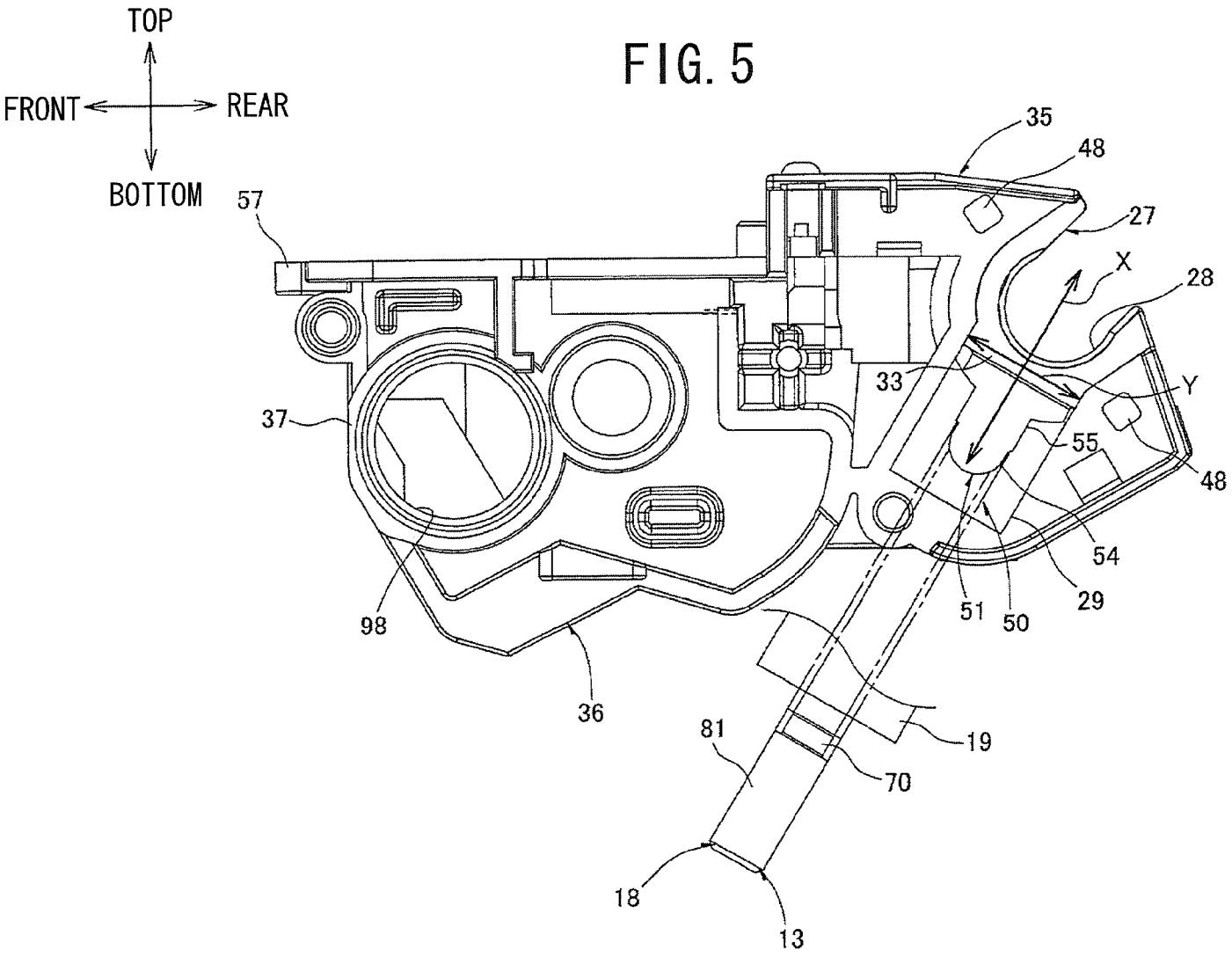
FIG. 5 is a right side view of the lower frame shown in FIG. 4.

As shown in FIGS. 4 and 5, in the developer frame 30, first openings 27 are formed at mutually opposing positions in the left and right side walls 34 and 35, respectively. The first openings 27 are recesses formed in the upper rear edges of the corresponding left and right side walls 34 and 35 that penetrate toward the bottom front sides of the same along the direction X (see FIGS. 3 and 5) corresponding to the direction in which a rubber roller 17 and a sponge roller 19 (described later) oppose each other.

A bridge part 33 is also provided on each of the left and right side walls 34 and 35 (see FIGS. 4 and 5). The bridge part 33 span in a direction Y orthogonal to the left-right direction and the direction X through the approximate center region of the corresponding first opening 27 relative to the direction X. That is, each bridge part 33 divides the corresponding first opening 27 into a developing-roller-shaft-exposing groove 28 occupying the upper portion of the first opening 27, and a supply-roller-shaft-exposing through-hole 29 occupying the lower portion. In other words, for each side walls 34 and 35, the grooves 28 and the holes 29 constitutes a penetration region. Each groove 28 constitutes a cutout of corresponding side walls 34 and 35.

As shown in FIG. 5, the exposing grooves 28 are substantially U-shaped in a side view and are recessed in a direction diagonally downward and forward from the upper-rear edges of the corresponding left and right side walls 34 and 35. The exposing grooves 28 are formed with a greater width than the diameter of left and right ends of a developing roller shaft 16 (described later). The developing roller shaft 16 inserted in the penetration regions of the side walls 34 and 35. When projected in the left-right direction, the developing roller shaft 16 is positioned in the groove 28 (cutout).

The exposing holes 29 are generally rectangular in a side view. The sides of the exposing holes 29 are formed longer than the diameter of left and right exposed parts 80 and 81 of a supply roller shaft 18 (described later). In the embodiment, the supply roller shaft 18 inserted in the penetration regions of the side walls 34 and 35. When projected in the left-right direction, the supply roller shaft 18 is disposed in the exposing holes 29.

As shown in FIG. 4, a pair of wall-side protruding parts 47 is provided on the outer side of the left side wall 34 at positions on diametrically opposing sides of the exposing groove 28. More specifically, one of the wall-side protruding parts 47 is disposed above the exposing groove 28 and the other below. The wall-side protruding parts 47 have a general columnar shape and protrude leftward from the left side wall 34.

As shown in FIG. 5, a pair of wall-side recessed parts 48 is formed in the outside of the right side wall 35 at positions on diametrically opposing sides of the exposing groove 28. More specifically, one of the wall-side recessed parts 48 is formed above the exposing groove 28 and the other below. The wall-side recessed parts 48 are generally rectangular in a side view and are depressed leftward into the right side wall 35. The upper wall-side recessed parts 48 is also formed as a through-hole that penetrates the right side wall 35 in the left-right direction (see FIG. 4).

A toner fill hole 98 is formed in the right side wall 35. The toner fill hole 98 is generally circular in a side view and is formed in a front-side portion of the right side wall 35.

As shown in FIG. 3, the front portion of the bottom wall 36 is formed continuously of a curved wall 40, and a bent wall 41, while the rear portion of the bottom wall 36 is formed continuously of an arc-shaped wall 42, and a rib part 43.

The curved wall 40 has a general arc shape that follows the rotational path of an agitator 12 (described later).

The bent wall 41 has an upward bend formed at a midpoint in the front-rear direction. More specifically, beginning from its rear edge, the bent wall 41 slopes upward toward the front from the front edge of the curved wall 40 and subsequently bends so as to slope downward toward the front.

The arc-shaped wall 42 has a general arc shape that follows the rotational path of a supply roller 13 (described later).

The rib part 43 has a general T-shape in a side view, with the bottom of the "T" formed continuously with the rear edge of the arc-shaped wall 42 and the head of the "T" protruding rearward.

The front portion and the rear portion of the bottom wall 36 are formed continuously by coupling the rear edge of the curved wall 40 with the front edge of the arc-shaped wall 42.

A partitioning wall 45 is formed between the front portion and the rear portion of the bottom wall 36. The partitioning wall 45 is formed as a continuous extension from the curved wall 40 and the arc-shaped wall 42, protruding upward. That is, the partitioning wall 45 protrudes toward the upper frame 32 while extending in the left-right direction (see FIG. 4).

The distal end of the partitioning wall 45 vertically confronts but is separated from the bottom surface of a rear-side top wall 53 (described later) of the upper frame 32.

As shown in FIG. 4, a plurality (two in the embodiment) of fixing parts 46 and a plurality (two in the preferred embodiment) of receiving parts 50 are formed on the bottom wall 36.

The fixing parts 46 are disposed adjacent to the front side of the partitioning wall 45 and are separated from each other in the left-right direction. The fixing parts 46 are generally cylindrical in shape and are erected upward from the curved wall 40, with their distal ends protruding out above the rear-side top wall 53 (described later; see FIG. 3).

The receiving parts 50 are disposed at positions spaced inward in right and left directions from the corresponding left and right side walls 34 and 35. The receiving parts 50 have a generally flat plate shape and protrude diagonally upward and rearward from the arc-shaped wall 42.

A receiving groove 51 is formed in each receiving part 50 for receiving the supply roller shaft 18 (described later). The receiving grooves 51 are generally U-shaped in a side view and are recessed into the receiving parts 50 in the direction X so as to be open on the upper rear side (see FIG. 4). As shown in FIG. 5, the receiving groove 51 formed in the right receiving part 50 has a lower portion defined as a narrow groove 54, and an upper portion defined as a wide groove 55.

The narrow groove 54 is generally U-shaped in a side view. The width of the narrow groove 54 (the length of the narrow groove 54 in a length direction orthogonal to the direction X and the left-right direction) is narrower than the width of the left receiving groove 51 (the length of the length direction of the left receiving groove 51) and wider than the diameter of a small-diameter part 70 formed on the supply roller shaft 18 (described later).

The wide groove 55 is formed continuously with the two ends of the narrow groove 54 (the ends at the open side of the narrow groove 54). After initially curving outward in the width direction, the wide groove 55 extends along the direction X. The width of the wide groove 55 (the length of the wide groove 55 in the length direction) is greater than that of the narrow groove 54 and approximately equivalent to that of the receiving groove 51. The width of the wide groove 55 (the length of the wide groove 55 in the length direction) is also substantially equivalent to the outer diameter of the supply roller shaft 18 (described later).

As shown in FIG. 5, a region defined by the wide groove 55 and the bridge part 33 when projected in the left-right direction has a length in the direction X greater than the diameter of the supply roller shaft 18 (described later). Hence, the wide groove 55 and the bridge part 33 define a space in which the supply roller shaft 18 can move freely.

As shown in FIG. 3, the bottom portion of the front wall 37 is formed continuously from the front edge of the bent wall 41, sloping upward toward the front, while the upper portion of the front wall 37 extends straight upward continuously from the top edge of the lower portion.

A second contact part 57 is formed on the top edge of the front wall 37. As shown in FIG. 4, the second contact part 57 has a generally flat plate shape that extends continuously forward from the top edge of the front wall 37.

(2-2) Upper Frame

As shown in FIG. 3, the upper frame 32 is integrally provided with a front-side top wall 52, and a rear-side top wall 53.

As shown in FIG. 2, the front-side top wall 52 is configured of an expanded part 58, and a contact part 62.

The expanded part 58 constitutes the central portion of the front-side top wall 52 and expands upward.

The contact part 62 has a substantially flat plate shape and is provided along both left and right sides and the front side of the expanded part 58 so as to surround the same. When the upper frame 32 is assembled to the lower frame 31, the contact part 62 conforms to the shape of the first and second contact parts 56 and 57.

As shown in FIG. 3, the rear-side top wall 53 has a generally flat plate shape and extends continuously rearward from the rear edge of the front-side top wall 52.

(2-3) Developer Frame

As shown in FIG. 3, when the lower frame 31 and the upper frame 32 are assembled together, as will be described later, a space formed in the developer frame 30 is divided by the partitioning wall 45 into the toner-accommodating chamber 38 constituting the space forward of the partitioning wall 45, and a developing chamber 39 constituting the space rearward of the partitioning wall 45. In other words, the partitioning wall 45 partitions the developer frame 30 into the toner-accommodating chamber 38 and the developing chamber 39.

(2-4) Toner-Accommodating Chamber

As shown in FIG. 3, the toner-accommodating chamber 38 is filled with toner. An agitator 12 is also provided in the toner-accommodating chamber 38 and positioned in the vertical and front-to-rear center thereof.

The agitator 12 includes a rotational shaft 83 that is rotatably supported in the side walls 34 and 35, and an agitating blade 84 provided on the rotational shaft 83.

The agitating blade 84 is formed of a flexible film material and is fixed to the outer peripheral surface of the rotational shaft 83 so as to extend radially outward therefrom.

By supporting the rotational shaft 83 in the left and right side walls 34 and 35, the agitator 12 is rotatably supported in the developer frame 30.

(2-5) Developing Chamber

A second opening 69 is formed in the rear side of the developing chamber 39. The second opening 69 is specifically defined by the rear edges of the left and right side walls 34 and 35, the rear edge of the rib part 43, and the rear edge of the rear-side top wall 53. The second opening 69 are continuously formed with the exposing grooves 28.

Provided inside the developing chamber 39 are the developing roller 6, the supply roller 13, and a thickness-regulating blade 14.

Figure 8:
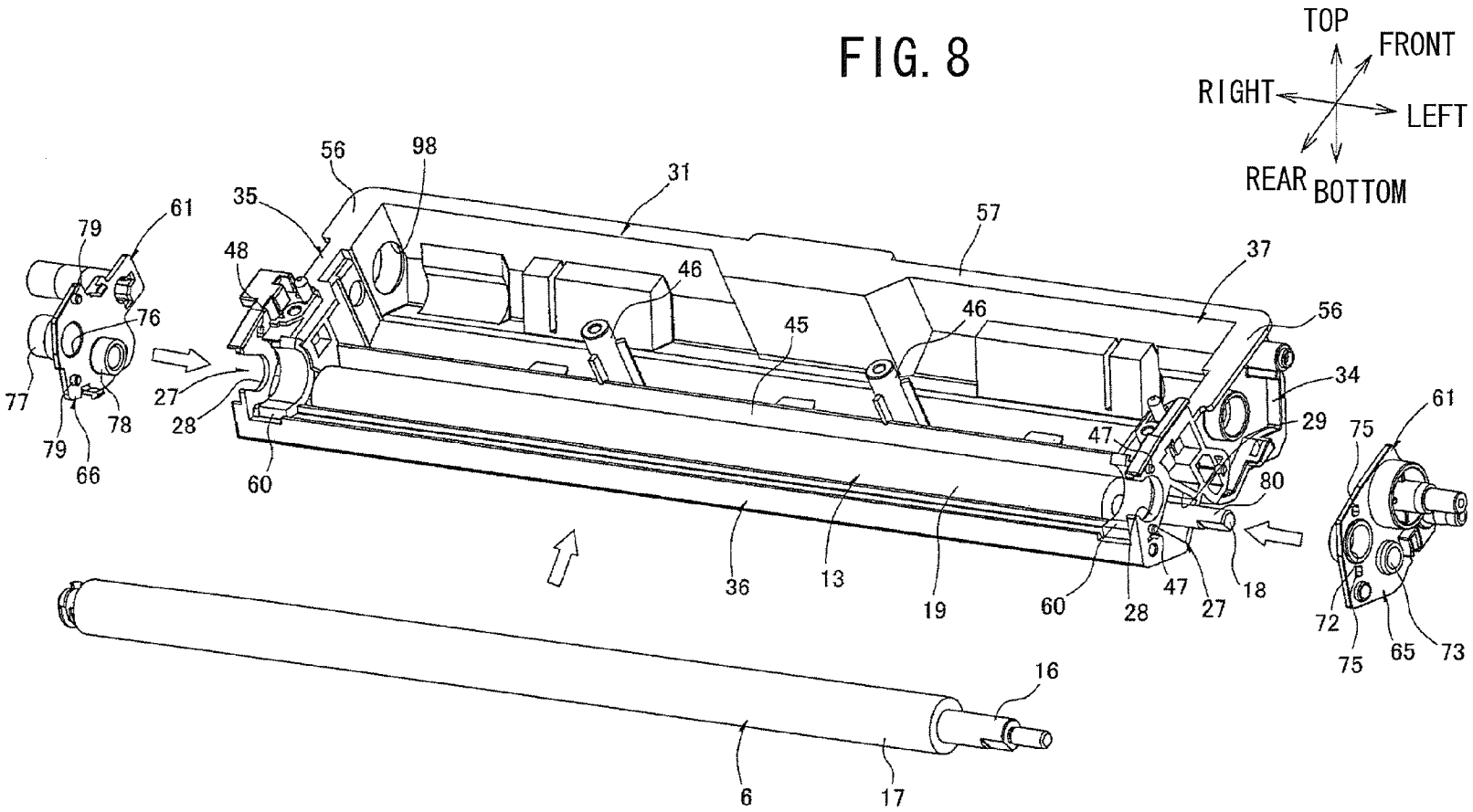
FIG. 8 is an explanatory diagram illustrating assembling bearing members and a developing roller in the lower frame.

The developing roller 6 is disposed in the rear end of the developing chamber 39 so that the rear and top portions of the developing roller 6 are exposed through the second opening 69. As shown in FIG. 8, the developing roller 6 is configured of a developing roller shaft 16, and a rubber roller 17. The rubber roller 17 covers the developing roller shaft 16 such that the left and right ends of the developing roller shaft 16 are exposed.

As will be described later in greater detail, by rotatably supporting the developing roller shaft 16 in the left and right side walls 34 and 35, the developing roller 6 is rotatably disposed in the developer frame 30.

Figure 7:
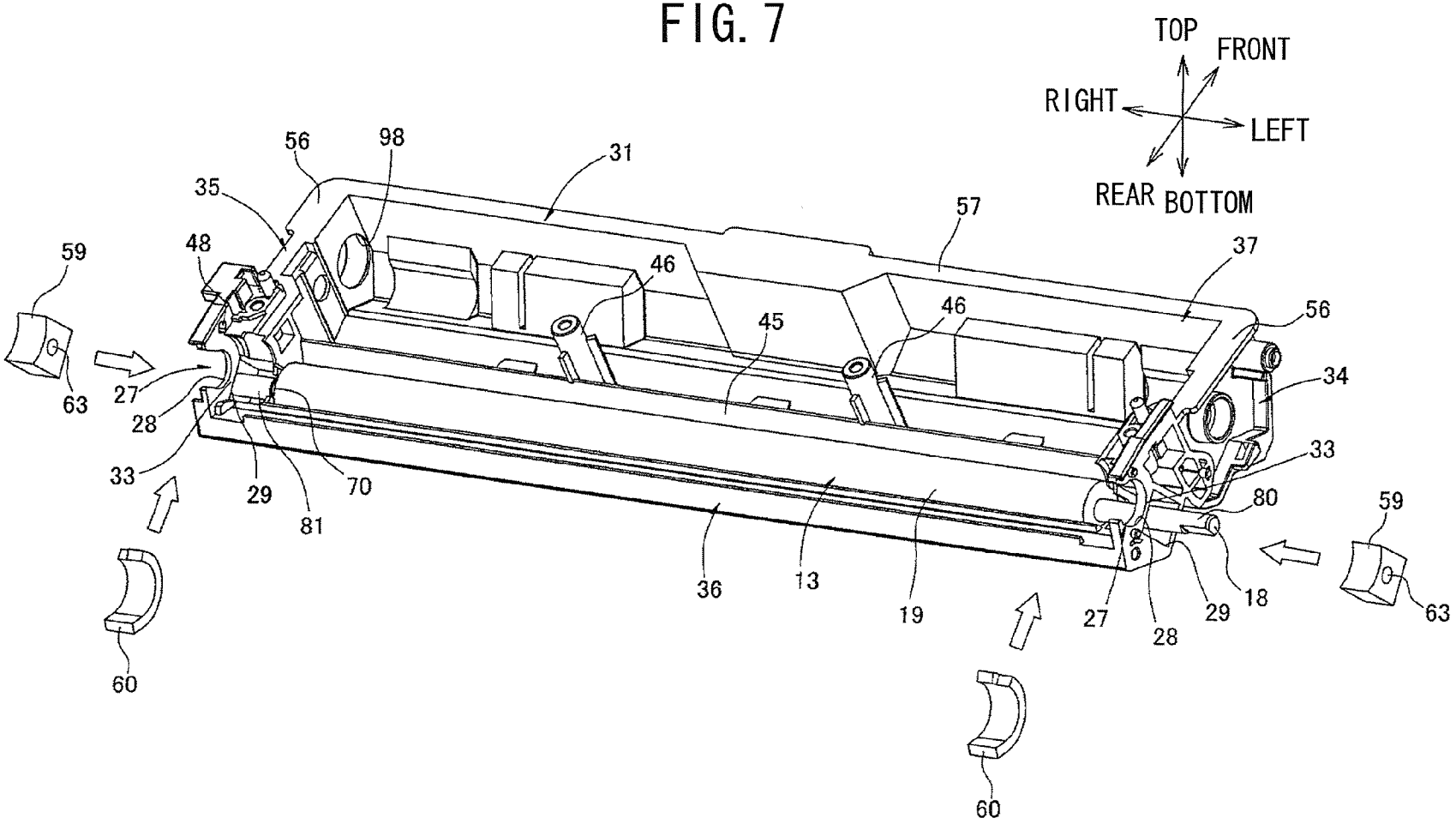
FIG. 7 is an explanatory diagram illustrating assembling first and second sealing members in the lower frame.

As shown in FIG. 3, the supply roller 13 is disposed inside the arc-shaped wall 42 on the lower front side of the developing roller 6. As shown in FIG. 7, the supply roller 13 includes a supply roller shaft 18, and a sponge roller 19.

Figure 6A:
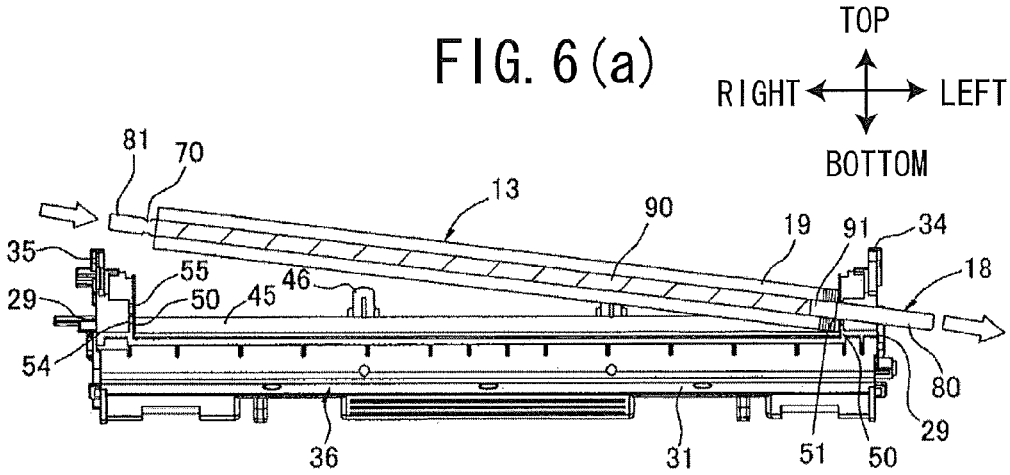
FIG. 6(*a*)-6(*c*) are an explanation diagram illustrating assembling a supply roller in the lower frame.
Figure 6B:
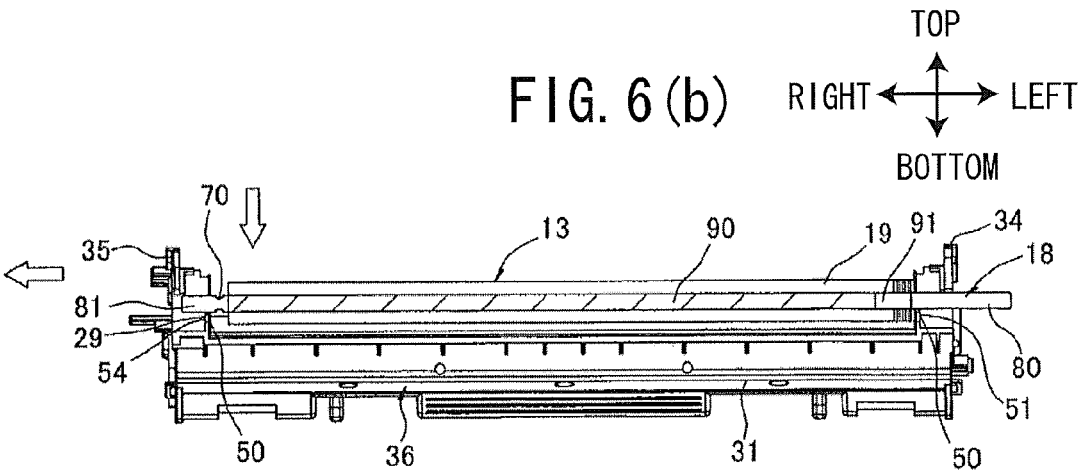
Figure 6C:
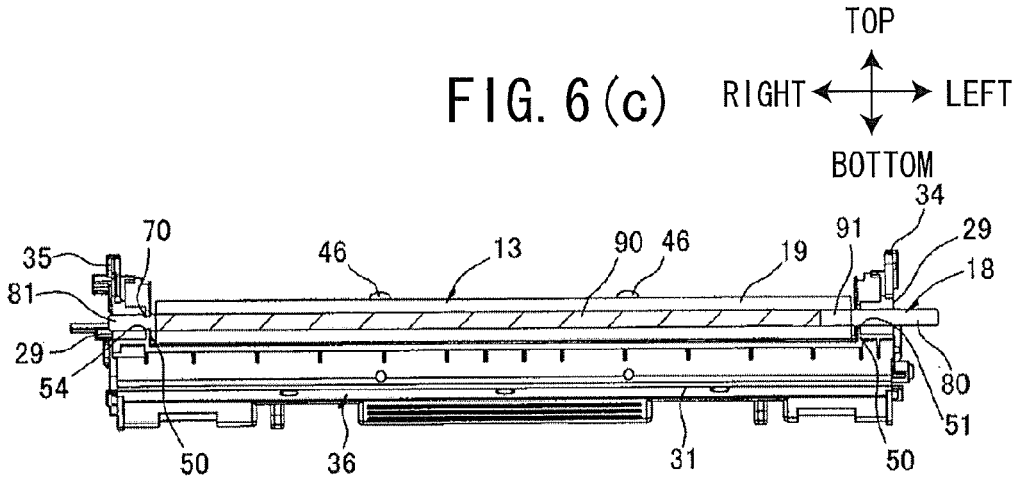

The sponge roller 19 serves to supply toner to the rubber roller 17. The sponge roller 19 covers the supply roller shaft 18 while leaving the left and right ends exposed. As shown in FIG. 6(*a*), the sponge roller 19 is adhesively fixed to the supply roller shaft 18 over an adhering region 90. The adhering region 90 over which the sponge roller 19 is fixed to the supply roller shaft 18 extends from the right edge of the sponge roller 19 to a midway point of the sponge roller 19 with respect to the left-right direction. That is, the adhering region 90 does not extend all the way to the left edge of the sponge roller 19. The region left of the adhering region 90 is defined as an elastically deformable region 91.

The left and right ends of the supply roller shaft 18 protrude outward from left and right sides of the sponge roller 19 and are respectively defined as left and right exposed parts 80 and 81.

The left exposed part 80 is formed longer in the left-right direction than the right exposed part 81.

As shown in FIG. 5, a small-diameter part 70 is formed in the right exposed part 81. The small-diameter part 70 is formed in the right exposed part 81 at a position corresponding to the narrow groove 54 formed in the right receiving part 50 and is formed by recessing the outer peripheral surface of the supply roller shaft 18 radially inward so that the diameter of the small-diameter part 70 is smaller than the diameter of the left exposed part 80.

The supply roller 13 is positioned so that the sponge roller 19 of the supply roller 13 confronts and contacts the rubber roller 17 of the developing roller 6. As will be described later in greater detail, by rotatably supporting the left and right ends of the supply roller shaft 18 in the left and right side walls 34 and 35, the supply roller 13 is rotatably provided in the developer frame 30.

As shown in FIG. 3, the thickness-regulating blade 14 is fixed to the distal ends of the fixing parts 46 so that the rear end portion of the thickness-regulating blade 14 contacts the top of the rubber roller 17.

As shown in FIGS. 7 and 8, two each of first side sealing members 59, second side sealing members 60, and bearing members 61 are provided in the developing chamber 39.

The first side sealing members 59 are disposed in positions corresponding to the exposing holes 29. The first side sealing members 59 are generally rectangular in a side view. A through-hole 63 penetrates the center portion of each first side sealing member 59 in the left-right direction to allow passage of the supply roller shaft 18. As will be described later in greater detail, the left and right ends of the supply roller shaft 18 are inserted through the corresponding first side sealing members 59, with one of the first side sealing members 59 positioned between the left receiving part 50 and the left side wall 34 and the other between the right receiving part 50 and the right side wall 35.

The second side sealing members 60 are generally U-shaped in a side view, following the curved shape on the lower side of the exposing grooves 28. As will be described later in greater detail, the second side sealing members 60 are disposed above the corresponding first side sealing members 59, with one second side sealing member 60 interposed between each of the left and right ends of the supply roller shaft 18 and corresponding one of the left and right ends of the developing roller shaft 16.

As shown in FIG. 8, the bearing members 61 are formed of a conductive resin material in a flat plate shape that is substantially rectangular in a side view. That is, the bearing members 61 are formed separately from the developer frame 30. The two bearing members 61 are further distinguished as a left bearing member 65 corresponding to the left side wall 34, and a right bearing member 66 corresponding to the right side wall 35.

The left bearing member 65 has a developing-roller-shaft-supporting hole 72, a supply-roller-shaft-supporting hole 73, and a pair of bearing-side recessed parts 75 formed therein.

The supporting hole 72 has a generally circular shape in a side view and penetrates the upper rear portion of the left bearing member 65. The supporting hole 72 is formed with substantially the same (slightly larger) diameter as the outer diameter of the developing roller shaft 16.

The supporting hole 73 has a generally circular shape in a side view and penetrates the left bearing member 65 on the lower front side of the supporting hole 72. The supporting hole 73 is formed with substantially the same (slightly larger) diameter as the outer diameter of the left exposed part 80.

The bearing-side recessed parts 75 are formed on diametrically opposing sides of the supporting hole 72 at positions corresponding to the wall-side protruding parts 47. In other words, one bearing-side recessed part 75 is formed above the supporting hole 72 while the other is formed below the supporting hole 72. The bearing-side recessed parts 75 have a generally rectangular shape in a side view and penetrate the left bearing member 65 in the left-right direction.

The right bearing member 66 has a developing-roller-shaft-supporting hole 76, a developing-roller-shaft collar 77, a supply-roller-shaft-supporting part 78, and a pair of bearing-side protruding parts 79.

The supporting hole 76 is generally circular in a side view and penetrates the upper rear portion of the right bearing member 66. The supporting hole 76 is formed with substantially the same (slightly larger) diameter as the outer diameter of the developing roller shaft 16.

The collar 77 has a generally cylindrical shape and protrudes rightward from the peripheral edge of the supporting hole 76.

The supporting part 78 is formed on the left surface of the right bearing member 66 at a position below and forward of the supporting hole 76. The supporting part 78 is generally cylindrical in shape and protrudes leftward from the left surface of the right bearing member 66. The supporting part 78 is formed with substantially the same (slightly larger) inner diameter as the outer diameter of the right exposed part 81.

The bearing-side protruding parts 79 are disposed on diametrically opposing sides of the supporting hole 76 at positions corresponding to the wall-side recessed parts 48. Specifically, one of the bearing-side protruding parts 79 is disposed above the supporting hole 76 and the other is disposed below the supporting hole 76. The bearing-side protruding parts 79 are formed in a substantially columnar shape and protrude leftward from the right bearing member 66.

As will be described later in greater detail, the left bearing member 65 is fitted into the first opening 27 formed in the left side wall 34 from the outer side thereof, while the right bearing member 66 is fitted into the first opening 27 formed in the right side wall 35 from the outer side thereof.

3. Assembling the Developer Cartridge

Next, the process for assembling the developer cartridge 23 will be described.

(1) Assembling the Supply Roller in the Lower Frame

To assemble the developer cartridge 23, first the supply roller 13 and the lower frame 31 are prepared as described above, and the supply roller 13 is assembled in the lower frame 31, as shown in FIGS. 6(*a*)-6(*c*). To assemble the supply roller 13 in the lower frame 31, first the left exposed part 80 of the supply roller shaft 18 is inserted from right to left through the left exposing hole 29 until the left end of the sponge roller 19 contacts the left receiving part 50, as shown in FIG. 6(*a*). At this time, the left end of the sponge roller 19 corresponding to the elastically deformable region 91 is elastically deformed while being compressed against the receiving part 50.

Next, as shown in FIG. 6(*b*), the right exposed part 81 is placed in the wide groove 55 of the right receiving part 50 with the left end of the sponge roller 19 remaining in contact with the left receiving part 50. Through this operation, the left exposed part 80 is arranged in the receiving groove 51 of the left receiving part 50 and the sponge roller 19 is accommodated in the developing chamber 39 with the supply roller 13 shifted leftward in the lower frame 31.

Next, the supply roller 13 is moved rightward, as illustrated in FIG. 6(*c*). At this time, the left and right exposed parts 80 and 81 move within the space defined by the corresponding wide grooves 55 and the bridge parts 33. When the small-diameter part 70 formed in the right exposed part 81 reaches a position above the narrow groove 54 as the supply roller 13 moves rightward, the small-diameter part 70 becomes engaged in the narrow groove 54 by the weight of the supply roller 13, thereby fixing the position of the supply roller 13 relative to the lower frame 31.

This completes the process of mounting the supply roller 13 in the lower frame 31. At this time, the left exposed part 80 of the supply roller shaft 18 is inserted through the left exposing hole 29 and protrudes leftward from the left side wall 34, while the right exposed part 81 is inserted through the right exposing hole 29 and protrudes rightward from the right side wall 35. When projected in the left-right direction, the supply roller shaft 18 is positioned within the supply-roller-shaft-exposing holes 29.

The left end portion of the sponge roller 19 corresponding to the elastically deformable region 91, which was elastically deformed when initially mounting the supply roller 13, is now restored and separated from the left receiving part 50.

(2) Mounting the First and Second Side Sealing Members in the Lower Frame

Next, the first and second side sealing members 59 and 60 are mounted in the lower frame 31. As shown in FIG. 7, to mount the first and second side sealing members 59 and 60 in the lower frame 31, first the first side sealing members 59 are inserted into the lower frame 31.

To mount the first side sealing members 59 in the lower frame 31, the first side sealing members 59 are positioned on the left and right outer sides of the corresponding left and right exposed parts 80 and 81, with their through-holes 63 aligned with the respective left and right exposed parts 80 and 81. Next, the first side sealing members 59 are inserted inward into the developing chamber 39 in respective left and right directions until coming into contact with respective left and right outer surfaces of the corresponding receiving parts 50 (FIG. 4). At this time, the left and right exposed parts 80 and 81 are inserted through the through-holes 63 formed in the first side sealing members 59.

Next, the second side sealing members 60 are placed above the corresponding first side sealing members 59. This completes the process for assembling the first and second side sealing members 59 and 60 in the lower frame 31.

(3) Mounting the Developing Roller in the Lower Frame

Next, the developing roller 6 is assembled in the lower frame 31. To mount the developing roller 6 in the lower frame 31, the developing roller 6 is inserted into the lower frame 31, as illustrated in FIG. 8, so that the left and right ends of the developing roller shaft 16 exposed from the rubber roller 17 are inserted into the corresponding exposing grooves 28 from the upper rear side thereof. This completes the operation for assembling the developing roller 6 to the lower frame 31.

At this time, one of the second side sealing members 60 is interposed between the left exposed part 80 of the supply roller shaft 18 and the left end of the developing roller shaft 16, and the other second side sealing member 60 is interposed between the right exposed part 81 and the right end of the developing roller shaft 16. When projected in the left-right direction, the developing roller shaft 16 is positioned within the exposing grooves 28.

(4) Assembling the Bearing Members on the Lower Frame

Next, the bearing members 61 are mounted on the lower frame 31. That is, as shown in FIG. 8, the left bearing member 65 is mounted on the left side wall 34 from the left side, and the right bearing member 66 is mounted on the right side wall 35 from the right side.

When mounting the left bearing member 65 on the left side wall 34, the left bearing member 65 is moved toward the left side wall 34 from the left side so that the left exposed part 80 is inserted through the supporting hole 73 and the left end of the developing roller shaft 16 is inserted through the supporting hole 72. At this time, the wall-side protruding parts 47 formed on the left side wall 34 become engaged in the corresponding bearing-side recessed parts 75.

Similarly, when mounting the right bearing member 66 on the right side wall 35, the right bearing member 66 is moved toward the right side wall 35 from the right side so that the right exposed part 81 is inserted through the supporting part 78 and the right end of the developing roller shaft 16 is inserted through the supporting hole 76 and the collar 77. At this time, the bearing-side protruding parts 79 formed on the right bearing member 66 are engaged in the corresponding wall-side recessed parts 48.

The above operation completes the process of mounting the bearing members 61 on the lower frame 31. After completing this operation, the left exposed part 80 is rotatably supported in the supporting hole 73 and the right exposed part 81 is rotatably supported in the supporting part 78. Further, the left and right ends of the developing roller shaft 16 are rotatably supported in the supporting hole 72 and the supporting hole 76 and collar 77, respectively.

(5) Assembling the Upper Frame and Thickness-Regulating Blade on the Lower Frame Next, the upper frame 32 is assembled to the lower frame 31, as illustrated in FIGS. 2 and 3. To assemble the upper frame 32 on the lower frame 31, the upper frame 32 is placed on top of the lower frame 31 such that the contact part 62 of the upper frame 32 is aligned with the first and second contact parts 56 and 57 of the lower frame 31. Subsequently, the contact part 62 is welded to the first and second contact parts 56 and 57.

Assembling the lower frame 31 and the upper frame 32 in this way forms the developer frame 30. At this time, the fixing parts 46 of the lower frame 31 protrude out from the rear-side top wall 53 (see FIG. 3). Note that when assembling the developer cartridge 23, the upper frame 32 may be first assembled to the lower frame 31 to form the developer frame 30, after which the supply roller 13, the first side sealing members 59, the second side sealing members 60, developing roller 6, and the bearing members 61 can be sequentially assembled as described above.

Next, the thickness-regulating blade 14 is fixed to the fixing parts 46. This completes assembly of the developer cartridge 23.

At this time, the rubber roller 17 of the developing roller 6 opposes and contacts the sponge roller 19 of the supply roller 13. Further, when projected in the left-right direction, the bridge parts 33 are positioned between the developing roller shaft 16 and the supply roller shaft 18.

Thereafter, the toner-accommodating chamber 38 is filled with toner via the toner fill hole 98. Once the toner-accommodating chamber 38 is filled, a cap (not shown) is press-fitted into the 98 to seal the toner in the toner-accommodating chamber 38.

4. Operational Advantages (1) With the developer cartridge 23 of the embodiment, the first opening 27, and the bridge part 33 for dividing the first opening 27 into the exposing groove 28 constituting the upper portion and the exposing hole 29 constituting the lower portion are provided both on the left and right side walls 34 and 35. Hence, the developer cartridge 23 of the embodiment can enhance the strength of the developer frame 30 through a simple construction, while improving accuracy in positioning the developing roller 6 and the supply roller 13 relative to each other.

Further, when projected in the left-right direction, the bridge parts 33 are positioned between the developing roller shaft 16 and the supply roller shaft 18. As a result, the operation for mounting the developing roller 6 and the supply roller 13 in the lower frame 31 is made more efficient since the developing roller shaft 16 and the supply roller shaft 18 need only be disposed in their corresponding positions.

(2) Further, the lower frame 31 has the bottom wall 36, and the receiving parts 50 in which are formed respective receiving grooves 51 are provided on the bottom wall 36. Accordingly, when mounting the supply roller 13 in the lower frame 31, the receiving grooves 51 can receive the supply roller shaft 18.

As a result, the supply roller 13 can be positioned relative to the lower frame 31 with accuracy. Hence, it is possible to improve accuracy in positioning the developing roller 6 and the supply roller 13 relative to each other through a simple construction.

(3) The left and right ends of the supply roller shaft 18 are defined as the left exposed part 80 and the right exposed part 81, respectively. The small-diameter part 70 is formed in the right exposed part 81. Further, the receiving parts 50 are disposed one inside each of the left and right side walls 34 and 35 with respect to the left-right direction so that a gap is formed between the receiving parts 50 and corresponding left and right side walls 34 and 35. The narrow groove 54 is formed in the right receiving part 50. With this construction, the small-diameter part 70 engages with the narrow groove 54 when the supply roller 13 is assembled in the lower frame 31. This construction positions the supply roller shaft 18 in the left-right direction relative to the lower frame 31, thereby positioning the supply roller 13 relative to the lower frame 31 with accuracy.

(4) The wide groove 55 is also provided in the right receiving part 50 and is formed continuously with the narrow groove 54. Together with the bridge part 33, the wide groove 55 defines a space in which the supply roller shaft 18 can move freely. Hence, when mounting the supply roller 13 in the lower frame 31, the supply roller 13 can move within the range of movement in which the supply roller shaft 18 can move freely.

Hence, this construction makes the operation for mounting the supply roller 13 in the lower frame 31 more efficient, while still enhancing the strength of the developer frame 30 (lower frame 31).

(5) Further, the right exposed part 81 is formed shorter than the left exposed part 80. This configuration makes it easier to engage the small-diameter part 70 and the narrow groove 54 than if the right exposed part 81 were longer.

(6) Since the bearing members 61 of the developer cartridge 23 are separate members from the developer frame 30, it is possible to replace just the bearing members 61, which are more prone to wear, thereby improving maintenance efficiency for the developer cartridge 23. Further, it is possible to reduce material costs by forming just the bearing members 61 of a material having superior tribological properties.

(7) A pair of wall-side protruding parts 47 is provided on the left side wall 34, while a pair of wall-side recessed parts 48 is formed in the right side wall 35. The top wall-side recessed part 48 penetrates the right side wall 35 in the left-right direction. The bearing members 61 include the left bearing member 65 and the right bearing member 66. A pair of bearing-side recessed parts 75 is formed in the left bearing member 65, while a pair of bearing-side protruding parts 79 is provided on the right bearing member 66. This construction can prevent the left and right bearing members 65 and 66 from being mistakenly mounted on the wrong left and right side walls 34 and 35.

(8) The developer cartridge 23 is assembled by placing the sponge roller 19 in the developing chamber 39 while the supply roller 13 is shifted leftward relative to the lower frame 31 and by subsequently moving the supply roller 13 rightward until the small-diameter part 70 engages with the narrow groove 54. Hence, even though the bridge parts 33 are provided in both the left and right side walls 34 and 35, the supply roller 13 can be easily mounted in the lower frame 31.

Further, the supply roller 13 can be easily positioned relative to the lower frame 31 by engaging the small-diameter part 70 with the narrow groove 54. Therefore, production efficiency for the developer cartridge 23 can be improved while enhancing the strength of the developer frame 30 (lower frame 31) and improving the accuracy for positioning the supply roller 13 relative to the developer frame 30 (lower frame 31).

(9) Further, when the right exposed part 81 is positioned in the developing chamber 39, the left end of the sponge roller 19 is compressed against the left side of the receiving part 50 and elastically deformed. Hence, through a simple structure, the right exposed part 81 can easily be placed in the exposing hole 29 of the lower frame 31 so that the sponge roller 19 can be accommodated in the developing chamber 39.

(10) The adhering region 90 between the sponge roller 19 and the supply roller shaft 18 extends from the right edge of the sponge roller 19 to a left-right midpoint of the same. A region left of the adhering region 90 is defined as the elastically deformable region 91. Hence, elastic deformability of the sponge roller 19 can be ensured through a simple structure.

5. Second Embodiment

Figure 9A:
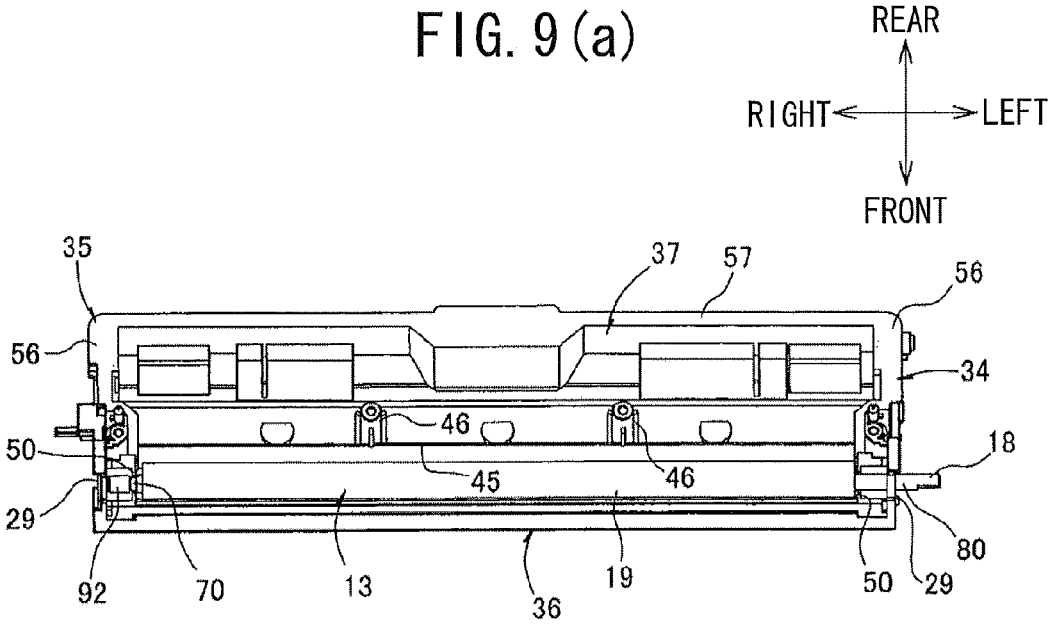
FIG. 9(*a*) is a plan view of the lower frame in a developer cartridge according to a second embodiment of the present invention.
Figure 9B:
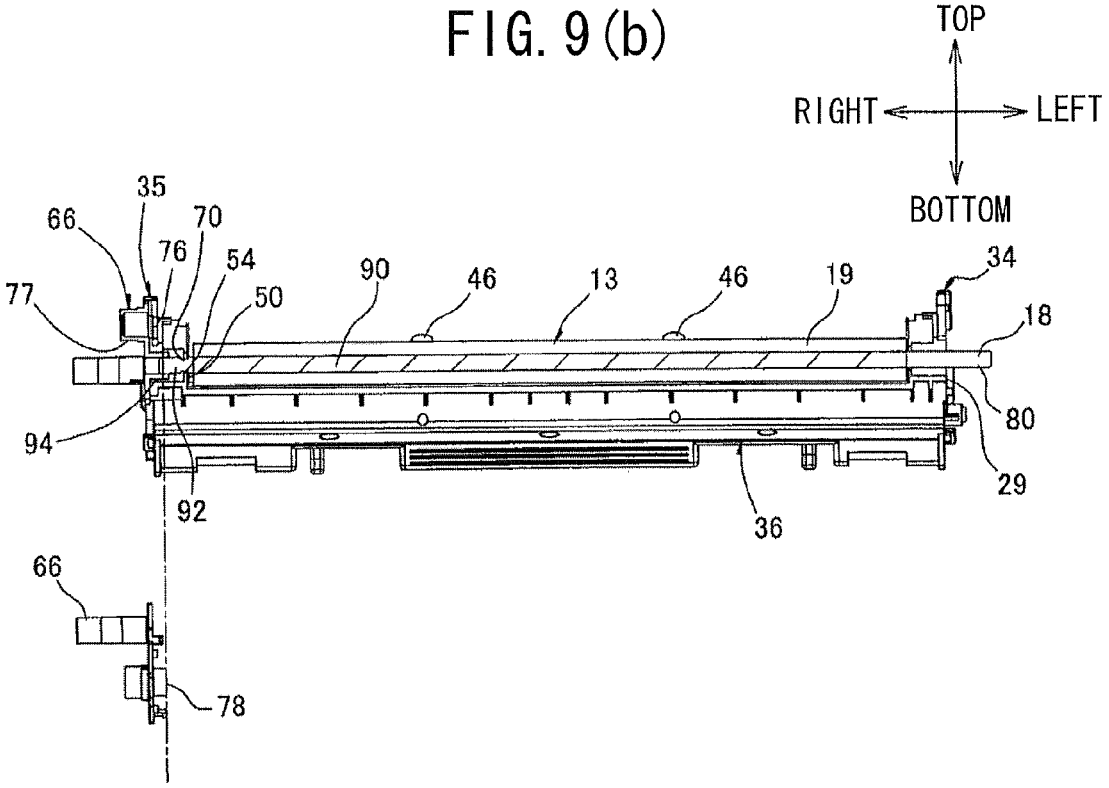

Next, a second embodiment of the present invention will be described. FIG. 9(*a*) is a plan view of the lower frame 31 in a developer cartridge according to the second embodiment of the present invention, wherein like parts and components to those described in FIGS. 1 through 8 are designated with the same reference numerals to avoid duplicating description.

As described in the first embodiment with reference to FIG. 6(*c*), the right exposed part 81 is formed to protrude rightward from the right side wall 35 when the supply roller 13 is mounted in the lower frame 31. However, in the second embodiment shown in FIG. 9(*a*), a right exposed part 92 is formed with a shorter left-right dimension than the right exposed part 81 of the first embodiment and, hence, is accommodated inside the developing chamber 39 when the supply roller 13 is mounted in the lower frame 31.

As shown in FIG. 9(*b*), the right exposed part 92 is supported in a supply-roller-shaft-supporting part 94 provided in the right bearing member 66. The supporting part 94 has a generally cylindrical shape and protrudes leftward from the left surface of the right bearing member 66. The supporting part 94 is formed with a longer left-right dimension than that of the supporting part 78 (FIG. 8) described in the first embodiment. The supporting part 94 is inserted through the right exposing hole 29 and protrudes leftward from the right side wall 35 for supporting the right exposed part 92.

Consequently, to mount the supply roller 13 in the lower frame 31, the left exposed part 80 can be inserted into the left exposing hole 29, and the sponge roller 19 can be placed into the developing chamber 39 without the right exposed part 92 contacting the bridge part 33 and without the sponge roller 19 elastically deforming by contacting the left receiving part 50. This construction can make the operation for mounting the supply roller 13 in the lower frame 31 more efficient.

This construction can improve production efficiency for the developer cartridge 23 while enhancing the strength of the developer frame 30 (lower frame 31). Further, since the supporting part 94 extends farther leftward than the right side wall 35, the supporting part 94 can reliably support the right exposed part 92.

Since it is not necessary to elastically deform the left end of the sponge roller 19 when mounting the supply roller 13 in the lower frame 31 in the second embodiment, the adhering region 90 can be provided along the entire left-right dimension of the sponge roller 19.

6. Third and Fourth Embodiments

Figure 10A:
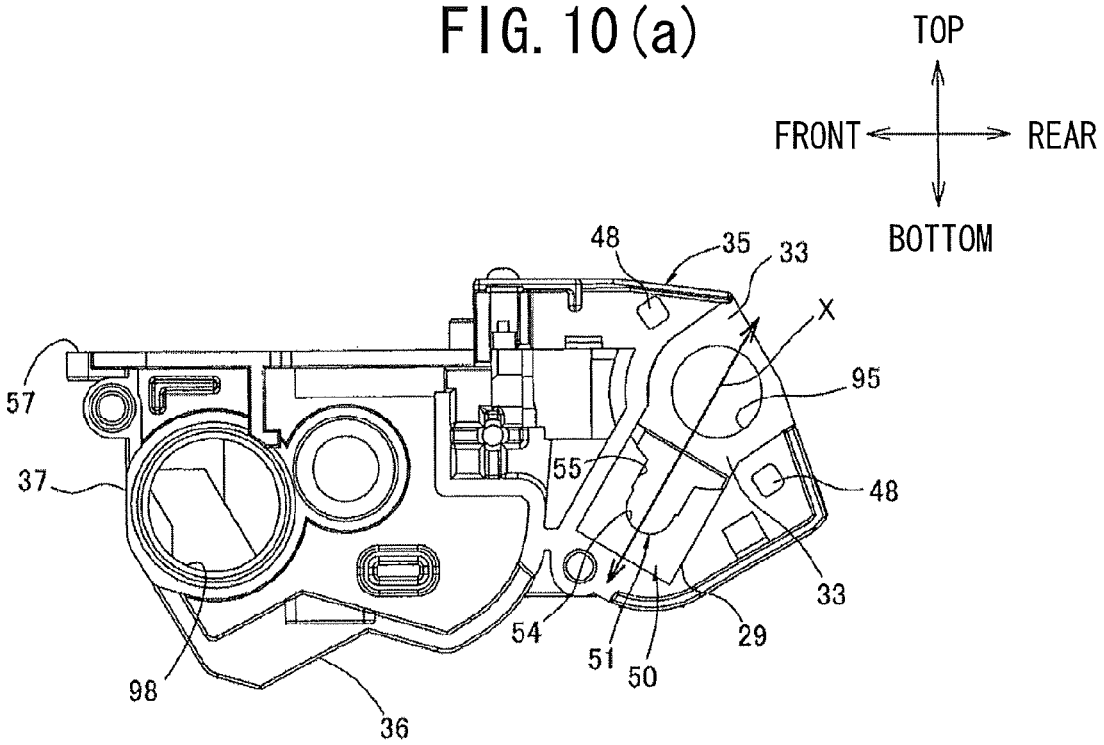
FIG. 10(*a*) is a right side view of a lower frame according to a third embodiment.
Figure 10B:
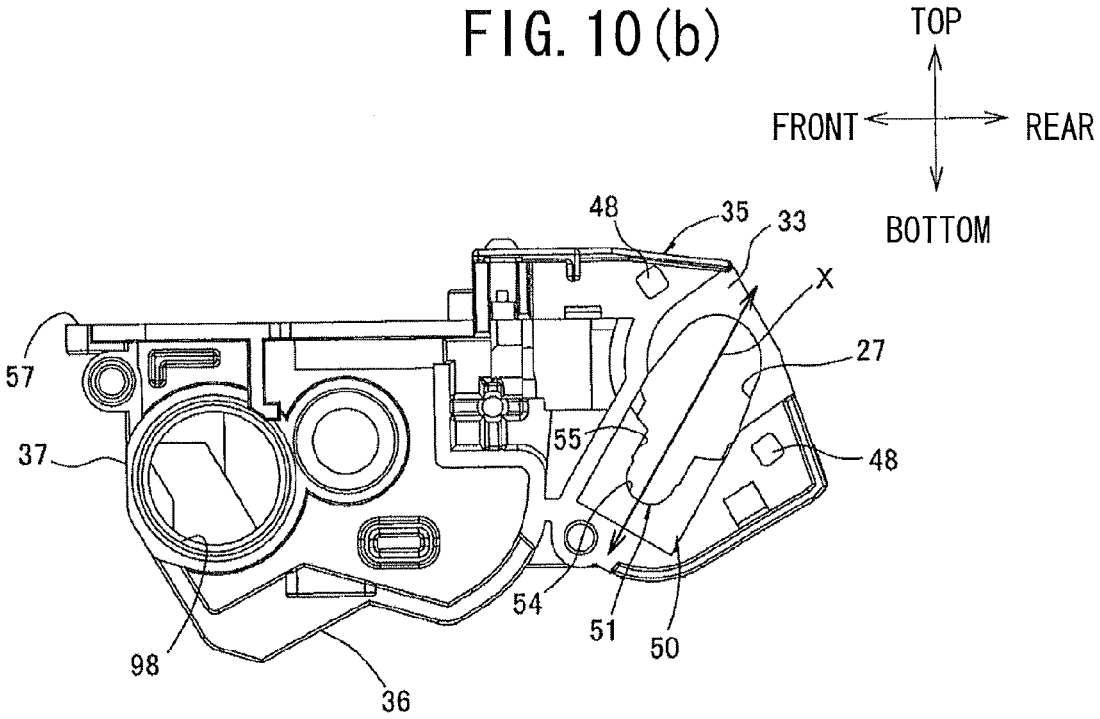

Next, third and fourth embodiments of the invention will be described. FIGS. 10(*a*) and 10(*b*) include right side views of the lower frame 31 in a developer cartridge according to the third and fourth embodiments respectively, wherein like parts and components to those described in FIGS. 1 through 8 are designated with the same reference numerals to avoid duplicating description.

As shown in FIG. 5 of the first embodiment, a bridge part 33 is provided for dividing each first opening 27 into a developing-roller-shaft-exposing groove 28 occupying the upper portion and a supply-roller-shaft-exposing hole 29 occupying the lower portion. However, in the third embodiment of the invention shown in FIG. 10(*a*), an additional bridge part 33 may be provided between the rear ends of the first opening 27. Specifically, the additional bridge part 33 defines a developing-roller-shaft-exposing hole 95 in the upper portion of the first opening 27. In other words, the exposing hole 95 is formed in at least one of the side walls 34 and 35 instead of the groove(s) 28.

In the fourth embodiment of the invention shown in FIG. 10(*b*), the bridge part 33 spanning between the rear ends of the first opening 27 is provided in place of the bridge part 33 dividing the first opening 27 into upper and lower portions. In this case, the first opening 27 is formed as an elongate hole extending in the direction X.

The developer cartridge according to the third and fourth embodiments can obtain the same operational advantages described in the first embodiment.

Note that the developing roller 6 may be rotatably supported in the lower frame 31 according to the same method used for mounting the supply roller 13 in the lower frame 31. If the left and right ends of the developing roller shaft 16 protrude outward in left and right directions from the left and right side walls 34 and 35 when the developing roller 6 is mounted in the lower frame 31, for example, then the developing roller 6 may be mounted in the lower frame 31 by configuring the left end of the rubber roller 17 to compress and elastically deform when contacting the inner surface of the left side wall 34 around the periphery of the first opening 27. Alternatively, if the right end of the developing roller shaft 16 is accommodated inside the developing chamber 39 when the developing roller 6 is mounted in the lower frame 31, a generally cylindrical developing-roller-shaft-supporting part (not shown) may be provided around the periphery of the supporting hole 76 and extending leftward from the right bearing member 66.

The present invention may also apply to any combination of the first through fourth embodiments described above.

What is claimed is:

1. A developer cartridge comprising:

a developing roller rotatable about a first axis extending in a first direction, the developing roller including a developing roller shaft extending in the first direction, and the developing roller shaft having a first end portion and a second end portion in the first direction, the first end portion being separated from the second end portion;

a housing accommodating developer therein, the housing including:

a first wall formed with a first hole and a second hole, a second wall separated from the first wall in the first direction, the second wall formed with a third hole and a fourth hole, a first bridge portion separating the first hole and the second hole in the first wall, and a second bridge portion separating the third hole and the fourth hole in the second wall; and a supply roller rotatable about a second axis extending in the first direction, the supply roller configured to supply the developer to the developing roller, the supply roller including a supply roller shaft extending in the first direction, the supply roller shaft including a third end portion and a fourth end portion in the first direction, the third end portion being separated from the fourth end portion, a diameter of the third end portion being smaller than a diameter of the fourth end portion, wherein the first hole and the third hole are aligned in the first direction, wherein the second hole and fourth hole are aligned in the first direction, wherein the first end portion is positioned in the first hole, wherein the second end portion is positioned in the third hole, wherein the third end portion is positioned in the second hole, wherein the fourth end portion is positioned in the fourth hole, and wherein the developer cartridge further comprises:

a first receiving groove configured to receive the third end portion in a state where the third end portion is inserted into the second hole; and a second receiving groove configured to receive the fourth end portion in a state where the fourth end portion is inserted into the fourth hole, wherein a width of the first receiving groove is narrower than a width of the second receiving groove.

2. The developer cartridge according to claim 1, wherein the first bridge portion is positioned between the first hole and the second hole, and wherein the second bridge portion is positioned between the third hole and the fourth hole.

3. The developer cartridge according to claim 1, wherein the first bridge portion is positioned between the first end portion and the third end portion, and wherein the second bridge portion is positioned between the second end portion and the fourth end portion.

4. The developer cartridge according to claim 3, wherein the first bridge portion is positioned between the first end portion and the third end portion in a second direction defined by connecting a center of the developing roller shaft and a center of the supply roller shaft, and wherein the second bridge portion is positioned between the second end portion and the fourth end portion in the second direction.

5. The developer cartridge according to claim 1, wherein a length of the first end portion in the first direction is shorter than a length of the second end portion in the first direction.

6. The developer cartridge according to claim 1, further comprising:

a first sealing member positioned in the second hole; and a second sealing member positioned in the fourth hole.

7. The developer cartridge according to claim 6, wherein the third end portion is inserted into the first sealing member, and wherein the fourth end portion is inserted into the second sealing member.

* * * * *